US006775354B1

(12) United States Patent
Roffers

(10) Patent No.: US 6,775,354 B1
(45) Date of Patent: Aug. 10, 2004

(54) METHOD AND APPARATUS FOR REDUCING HIGH VOLTAGE BREAKDOWN EVENTS IN X-RAY TUBES

(75) Inventor: Richard Michael Roffers, Whitefish Bay, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 09/666,000

(22) Filed: Sep. 20, 2000

(51) Int. Cl.[7] ..... H01J 35/14
(52) U.S. Cl. ..... 378/138; 378/113
(58) Field of Search ..... 378/138, 139, 378/113, 137, 101

(56) References Cited

U.S. PATENT DOCUMENTS 6,259,765 B1 * 7/2001 Baptist ..... 378/138

* cited by examiner

*Primary Examiner*—Craig E. Church
(74) *Attorney, Agent, or Firm*—McAndrews, Held & Malloy, Ltd.; Peter J. Vogel; Michael A. Dellapenna

(57) ABSTRACT

An X-ray tube subsystem including an X-ray tube and a grid voltage supply that reduces high voltage breakdown events. The X-ray tube provides a grid bias connection, a filament bias connection, and an anode bias connection. The grid voltage supply is connected to the grid bias connection and is adapted to produce an ion collection voltage substantially less than an electron beam focus voltage.

19 Claims, 2 Drawing Sheets

METHOD AND APPARATUS FOR REDUCING HIGH VOLTAGE BREAKDOWN EVENTS IN X-RAY TUBES

BACKGROUND OF THE INVENTION

The present invention relates to X-ray tubes. In particular, the present invention relates to a method and apparatus for reducing high voltage breakdown events in X-ray tubes.

X-ray imaging systems have long been available to doctors as a valuable tool for examination and diagnosis. X-ray imaging systems rely on an evacuated high voltage (e.g., 30–150 kV) X-ray tube. The X-ray tube produces an X-ray beam by generating an electron beam at the tube cathode, focusing the electron beam through a focus grid, and impacting the electron beam upon a tube anode. A steady, predictable X-ray beam greatly enhances the diagnostic usefulness of an X-ray system. However, past X-ray tubes suffered from a deleterious effect called high voltage breakdown or vacuum arcing that interrupted the steady X-ray beam.

The prevailing theory on electrical breakdown of the vacuum gap in the X-ray tube is predicated on the intensification of the electric field near the cathode surface caused by positive ion space charge formation in the region above the cathode surface. The electric field intensification results in an increase in localized currents from field emission sites on much of the cathode surface as well as neutralization of negative thermionic space charge about the filament that serves to reduce the electrostatic shielding of emitters found in that region. When the current density from an emitter is high enough to cause substantial Joule heating of the emitter tip, the constituent emitter material can sublime into the vacuum gap where it can be ionized. Ensuing plasma formation and high voltage breakdown results in the vacuum gap across the gap between the cathode to anode.

High voltage breakdown events short circuit the X-ray tube and interrupt the X-ray beam. In order to mitigate the interruptions, X-ray tubes undergo an extensive burn-in procedure after manufacture. The burn-in procedure attempts to eliminate, through electrical discharge, cathode field emission sites by allowing high voltage breakdowns to occur in a controlled fashion. While the burn-in procedure helps to reduce high voltage breakdowns in installed X-ray systems to a certain extent, the burn-in procedure does not completely eliminate all field emission sites. As a result, installed X-ray systems continue to experience high voltage breakdowns and the resultant interruptions in the X-ray beam.

A need has long existed in the industry for a method and apparatus for reducing high voltage breakdown events in X-ray tubes that addresses the problems noted above, and others previously experienced.

BRIEF SUMMARY OF THE INVENTION

A preferred embodiment of the present invention provides an X-ray tube subsystem including an X-ray tube and a grid voltage supply. The X-ray tube provides a grid bias connection, a filament bias connection, and an anode bias connection. The grid voltage supply is connected to the grid bias connection and filament bias connection, and is adapted to produce an ion collection voltage substantially less than an electron beam focus voltage, to sweep free ions out of the X-ray tube.

Another preferred embodiment of the present invention provides a method for operating an X-ray system to reduce high voltage breakdown events. The method includes the steps of providing an X-ray tube that includes a grid bias connection and filament bias connection. In addition, during X-ray tube operation, the method creates an ion collection voltage between the grid bias connection and the filament bias connection that is substantially less than an electron beam focus voltage, to sweep free ions out of the X-ray tube.

DETAILED DESCRIPTION OF THE INVENTION

Figure 1:
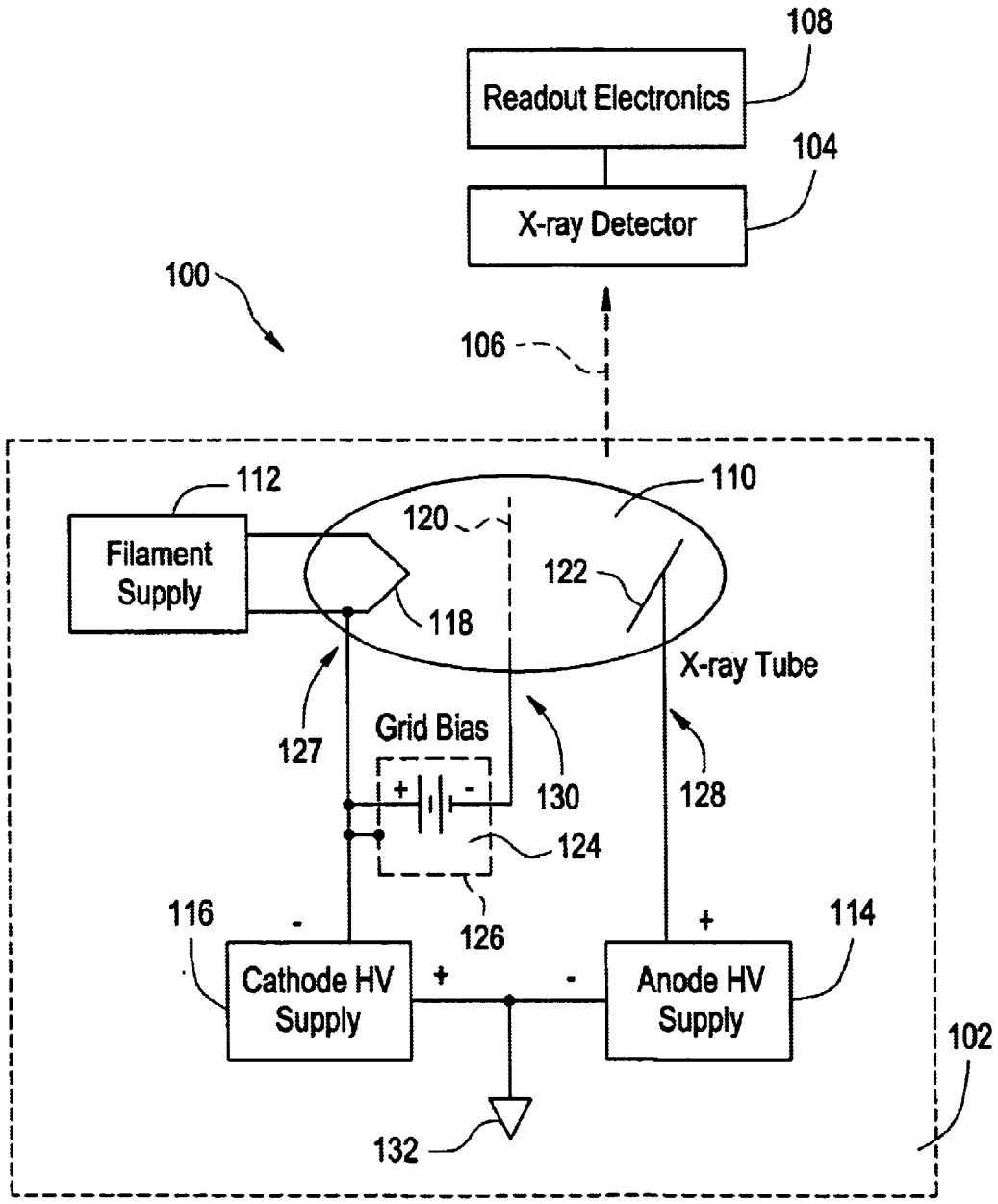
FIG. 1 shows an X-ray examination system including an X-ray tube subsystem.

Turning now to FIG. 1, that figure shows an X-ray examination system 100 including an X-ray tube subsystem 102, an X-ray detector 104 positioned to receive the X-ray beam 106, and readout electronics 108 connected to the X-ray detector 104 (e.g., film, or a solid state X-ray detector).

The X-ray tube subsystem 102 includes an X-ray tube 110 and supporting filament voltage supply 112, anode voltage supply 114, and cathode voltage supply 116. Internal to the X-ray tube is a filament 118, a focus grid 120 (sometimes referred to as a grid, or cup), and a rotating anode 122. A focus grid voltage supply 124 (which may be a fixed or variable voltage supply) is connected between the focus grid and the filament. An optional Faraday cage 126 surrounds the focus grid voltage supply 124. FIG. 1 also generally indicates external connections to the X-ray tube including the filament bias connection 127, anode bias connection 128, and the grid bias connection 130, to which the voltage supplies 112–116 connect. A reference earth ground is indicated at 132.

During operation of the X-ray tube 110, the filament voltage supply 112 produces a filament voltage on the order of 10 to 40 volts at approximately 4 to 10 amps in order to heat the filament to the extent required to produce free electrons. The anode voltage supply 114 and the cathode voltage supply 116 provide a working voltage across the X-ray tube of approximately 30–150 kV in order to accelerate the electrons into an electron beam that impacts the rotating anode 122 at very high velocity. The result is the X-ray beam 106. In one embodiment, the anode voltage supply produces a voltage in the range 15 kV to 75 kV, and the cathode voltage supply produces a voltage in the range −15 kV to −75 kV referenced to the earth ground 132.

The grid voltage supply 124 produces a positive ion collection voltage on the order of 10 to 30 volts at several milliamps, The ion collection voltage sweeps free positive ions out of the X-ray tube 110 and, as explained in more detail below, reduces high voltage breakdown events in the X-ray tube 110. Note that the focus grid 120 may also be used to focus the electron beam or to stop the electron beam from reaching the anode 122. However, the voltage typically required to focus the electron beam is on the order of 100 to 300 volts, while the voltage typically required to stop the electron beam is on the order of several kilovolts. Thus, the relatively small ion collection voltage neither interferes with electron beam focusing, nor propagation of the electron beam to the anode.

The Faraday cage 126 is connected to the filament bias connection. As a result, the Faraday cage 126 provides an electromagnetic shield for the components operating inside the focus grid supply 124. The Faraday cage 126 is preferably provided when electromagnetically sensitive components are used to generate the ion collection voltage.

The normal operation of the X-ray tube 110 results in positive ion space charge formation around the cathode (i.e., the filament 118 and focus grid 120) as a result, for example, of collisions of electrons with residual gas molecules in the X-ray tube 110. The ion collection voltage sweeps away the positive ions and eliminates their effect on the electric field around the cathode. The absence of the positive ion space charge above the cathode surface results in a relative uniform electric field, or potential gradient, between the anode and cathode and lowers the probability of high voltage breakdowns.

On the other hand, when present, the positive ion space charge intensifies the electric field between the cathode and the region of space including the positive ion space charge. The probability of the high voltage breakdown increases dramatically because intensified electric field generates addition current and therefore additional heat in the field emitters on the cathode. The heating eventually causes sublimation of cathode material into the X-ray tube 110. A high voltage breakdown or vacuum arc results, and the X-ray beam 106 is undesirably shut off until the high voltage breakdown subsides.

Secondarily, during normal operation of the X-ray tube 100, a negative space charge exists near the filament due to electrons leaving the filament to form the electron beam. The negative space charge has a shielding effect on the field emitters on the filament surface. However, the positive ions interact with and neutralize electrons around the filament. The shielding effect is reduced, the local electric field is increased, and the field emitters are more susceptible to the heating mechanism explained above that causes high voltage breakdowns.

However, the ion collection voltage applied between the focus grid 120 and the filament 118 draws away the positive ions above the cathode surface. The two breakdown mechanisms identified above are therefore far less likely to occur. The result is that high voltage breakdowns are less frequent.

Figure 2:
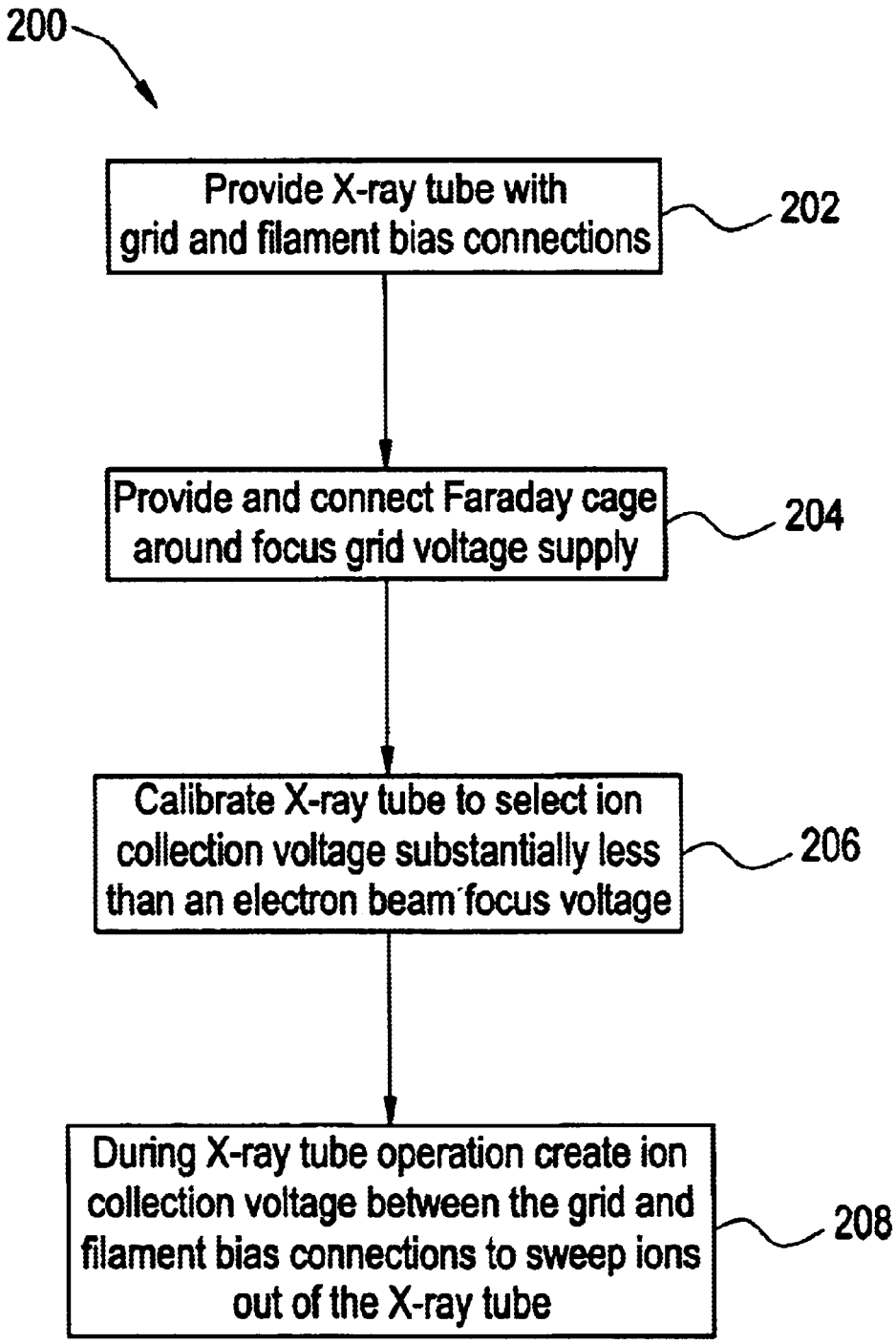
FIG. 2 illustrates a method of operating an X-ray tube examination system.

Turning next to FIG. 2, that figure illustrates a flow diagram 200 of the steps that occur before and during operation of the X-ray examination system 100. At step 202, an X-ray tube with grid and filament bias connections is provided. At step 204, a Faraday cage is provided around the focus grid voltage supply. Next, at step 206, the ion collection voltage that the focus grid supply will generate is selected. As noted above, the ion collection voltage is generally between 10 to 30 volts, and may be selected by operating and observing the X-ray tube 110 to determine which ion collection voltage results in the greatest reduction in high voltage breakdowns. During operation of the tube, the ion collection voltage is generated between the focus grid 120 and filament 118 to sweep positive ions out of the X-ray tube 110.

The net effect of the small negative ion collection voltage is a reduction in the probability of high voltage breakdown events in the X-ray tube 110. As a result, there are fewer interruptions in the X-ray beam 106. The X-ray system 100 thus operates in a more reliable, consistent, and diagnostically useful manner.

While the invention has been described with reference to a preferred embodiment, it will be understood by those skilled in the art that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. An X-ray tube subsystem comprising:

an X-ray tube including a grid connected to a grid bias connection, a cathode connected to a filament bias connection, an anode connected to an anode bias connection; and a grid voltage supply connected between the grid bias connection and the filament bias connection, said grid voltage supply producing a positive ion collection voltage on the order of 10 to 30 volts.

2. The X-ray tube subsystem of claim 1, wherein said X-ray tube forms positive ions about said cathode, and said grid voltage supply is a variable grid voltage supply.

3. The X-ray tube subsystem of claim 1, wherein said grid is adapted to receive a focus voltage, a stop voltage and said ion collection voltage.

4. The X-ray tube subsystem of claim 1, further comprising a Faraday cage surrounding the variable voltage supply.

5. The X-ray tube subsystem of claim 1 wherein said X-ray tube produces ions and said grid collects said ions at said grid to eliminate effects of said ions on an electric field around said cathode.

6. The X-ray tube subsystem of claim 1, further comprising a filament voltage supply connected to the filament bias connection.

7. The X-ray tube subsystem of claim 6, wherein a Faraday cage is connected to the filament voltage supply.

8. The X-ray tube subsystem of claim 6, further comprising an anode voltage supply connected to the anode bias connection and a ground reference, and a cathode voltage supply connected to an earth ground and the filament bias connection.

9. A method for operating an X-ray system to reduce high voltage breakdown events, the method comprising:

providing an X-ray tube that includes a grid connected to a grid bias connection and a cathode connected to a filament bias connection; and during X-ray tube operation, creating an ion collection voltage between the grid bias connection and the filament connection on the order of 10 to 30 volts.

10. The method of claim 9 wherein said X-ray tube produces ions and said grid collects said ions at said grid to eliminate effects of said ions on an electric field around said cathode.

11. The method of claim 9 wherein said X-ray tube produces positive ions about said cathode, and said ion collection voltage is created through a variable voltage supply.

12. The method of claim 9, further comprising providing a Faraday cage surrounding a grid voltage supply that creates the ion collection voltage.

13. The method of claim 12, further comprising providing a connection between the Faraday cage and the filament bias connection.

14. An X-ray examination system comprising:

an X-ray tube including a grid connected to a grid bias connection and a cathode connected to a filament bias connection;

a voltage supply connected between the grid bias connection and the filament bias connection, said grid voltage supply producing a positive ion collection voltage on the order of 10 to 30 volts to sweep free ions out of the x-ray tube;

an X-ray detector to receive an X-ray beam; and readout electronics connected to the X-ray detector.

15. The X-ray examination system of claim 14 wherein said X-ray tube produces ions and said grid collects said ions at said grid to eliminate effects of said ions on an electric field around said cathode.

16. The X-ray examination of claim 14, further comprising a Faraday cage surrounding the voltage supply.

17. The X-ray examination system of claim 16, wherein the Faraday cage is connected to the filament bias connection.

18. The X-ray examination system of claim 14 wherein said X-ray tube forms positive ions about said cathode, and said grid voltage supply is a variable grid voltage supply.

19. The X-ray examination system of claim 14, wherein the free ions are positive ions generated in proximity to an X-ray tube cathode during operation of the X-ray examination system.

* * * * *